United States Patent [19]

Yudate et al.

[11] Patent Number: 4,589,975

[45] Date of Patent: May 20, 1986

[54] METHOD OF PRODUCING A PRECURSOR PITCH FOR CARBON FIBER

[76] Inventors: Kozo Yudate; Yukihiro Ohsugi; Mamoru Kamishita; Ken Nagasawa, all of Chiba, Japan

[21] Appl. No.: 686,651

[22] Filed: Dec. 27, 1984

[30] Foreign Application Priority Data

Mar. 10, 1984 [JP] Japan ..... 59-44817

[51] Int. Cl.[4] ..... C10C 3/00; C10C 3/02; D01F 9/12

[52] U.S. Cl. ..... 208/44; 208/39; 208/22; 423/447.4

[58] Field of Search ..... 208/44, 39, 22; 423/447.4

[56] References Cited

U.S. PATENT DOCUMENTS

| | | | |
|---|---|---|---|
| 4,184,942 | 1/1980 | Angier et al. | 208/44 |
| 4,277,324 | 7/1981 | Greenwood | 208/39 |
| 4,397,830 | 8/1983 | Uemura et al. | 208/22 |
| 4,427,531 | 1/1984 | Dickakian | 208/44 |
| 4,436,615 | 3/1984 | Boodman et al. | 208/39 |
| 4,448,670 | 5/1984 | Dickakian | 208/22 |
| 4,460,557 | 7/1984 | Takashima et al. | 208/22 |
| 4,472,265 | 9/1984 | Otani | 208/22 |

FOREIGN PATENT DOCUMENTS

| | | | |
|---|---|---|---|
| 0063052 | 10/1982 | European Pat. Off. . | |
| 1679615 | 8/1979 | Japan | 208/44 |
| 2061998 | 5/1981 | United Kingdom . | |

OTHER PUBLICATIONS

Chemical Abstracts, vol. 100, No. 6, Feb. 1984, p. 64, No. 35,749m, Columbus, Ohio, U.S.A. & JP-A-58 144 126.

*Primary Examiner*—Andrew H. Metz
*Assistant Examiner*—Helane Myers
*Attorney, Agent, or Firm*—Balogh, Osann, Kramer, Kvorak, Genova & Traub

[57] ABSTRACT

A method of producing a precursor pitch for use in the production of carbon fibers, which comprises hydrogenating a soft or middle tar pitch to obtain a hydrogenated pitch containing no free carbon and high molecular weight components and then subjecting it to a heat treatment. In this method, the hydrogenation is carried out in the presence of tetralin at a temperature of 400°-450° C., and the heat treatment after the removal of solvent insoluble components and solvent is carried out in an inert gas atmosphere at a temperature of 450°-500° C. and under a reduced pressure of 0.1-10 Torr.

3 Claims, No Drawings

METHOD OF PRODUCING A PRECURSOR PITCH FOR CARBON FIBER

BACKGROUND OF THE INVENTION

1. Field of the Invention

This invention relates to a method of producing a precursor pitch for use in the production of carbon fibers, and particularly belongs to a technic for producing a homogeneous precursor pitch having a high thermal stability and a low viscosity, from which low molecular weight components and sublimating components are sufficiently removed by heat treatment for a relative short time, by using tetralin as a hydrogen donor solvent in a hydrogenation treatment for tar pitch.

2. Description of the Prior Art

As a process for producing a carbon fiber, there are two processes, one of which being the use of a synthetic fiber such as polyacrylonitrile (PAN) fiber and the like as a raw material and the other of which being the use of a tar pitch such as petroleum pitch, coal tar pitch and the like as a raw material. The former process has such a drawback that in addition to high cost of the raw fiber a carbonization yield is low.

On the other hand, as to the latter process, in order to obtain high-performance carbon fibers, a mesophase pitch which is a so-called optically anisotropic pitch must usually be used as a raw material. However, when using, for example, the petroleum pitch, physically and chemically various special treatments are essential, which take a great deal of work and time. The coal tar pitch contains a large amount of low molecular weight components due to the high temperature dry distillation and is poor in the infusibility, carbonization and graphitization, so that it is unsuitable for the production of high performance carbon fibers.

That is, the conventional pitches to be used as the raw material are suitable for carbon fibers of general-purpose grade using an optically isotropic pitch. When the isotropic pitch is heated in an inert gas atmosphere at a proper temperature (350°–500° C.) to form and grow an optically anisotropic phase in such isotropic fused body, the resulting product is a bulk mesophase pitch, which can be used as a raw material to produce high-performance carbon fibers having high strength and Young's modulus.

However, when the mesophase pitch is used as a raw material to conduct melt spinning, high molecular weight components composed of regularly arranged condensed rings are arranged in the axial direction of the fiber and consequently carbon fibers having high strength and Young's modulus are obtained, but the spinning is difficult because this mesophase pitch has a viscosity fairly larger than that of the isotropic pitch. Particularly, in order to obtain high-performance carbon fibers having a long length, the melt spinning step for the mesophase pitch is important and thus a mesophase pitch having an excellent spinnability must be provided.

SUMMARY OF THE INVENTION

It is an object of the invention to provide a method of producing a precursor pitch having particularly an excellent spinnability as a precursor pitch for use in the production of high-performance carbon fibers. As such a precursor pitch, the pitch must have a viscosity as low as possible and a highly homogeneous texture.

According to the invention, of in a method producing a precursor pitch for carbon fiber by hydrogenating a tar pitch to obtain hydrogenated pitch containing no free carbon and high molecular weight components and then subjecting it to a heat treatment, there is provided an improvement wherein the hydrogenation for a soft or middle pitch is carried out in the presence of tetralin at a temperature of 400°–450° C., and the heat treatment after the removal of solvent insoluble components and the solvent is carried out in an inert gas atmosphere at a temperature of 450°–500° C. under a reduced pressure of 0.1–10 Torr.

DETAILED DESCRIPTION OF THE INVENTION

According to the invention, a soft or middle pitch, (which is cheaply, plentifully and easily available as a tar pitch in industrial scale,) is subjected to a hydrogenation in the presence of tetralin as a hydrogenation solvent at a temperature of 400°–450° C., after which free carbon and solvent insoluble components inclusive of high molecular weight components in the pitch are separated and removed by a method of filtration, centrifugal separation, static separation or the like and subsequently the solvent is removed to produce a hydrogenated pitch containing no free carbon and high molecular weight components, and then the hydrogenated pitch is subjected to a heat treatment in an inert gas atmosphere at a temperature of 450°–500° C. under a reduced pressure of 0.1–10 Torr, whereby a low viscosity precursor pitch containing 10–30% by weight of quinoline insoluble matter and wholly composed of an anisotropic texture is obtained. Thus, the precursor pitch having excellent thermal stability and spinnability can easily be produced.

In the above method, one of the characteristic portions recognized by the inventors lies in the use of tetralin as a hydrogenation solvent. As such a hydrogenation solvent are known hydrides of aromatic hydrocarbons having two or three rings such as decalin, tetralin, dihydroindene, acenaphthene, di-, tetra-, hexa-, octa-, dodeca-, or tetradeca- hydroanthracene, di-, tetra-, hexa-, octa-, dodeca-, or tetradeca-hydrophenanthrene and their hydrides substituted by an alkyl group having 1–3 carbon atoms; 1,2,3,4-tetrahydroquinoline (THQ) known as a most effective hydrogenation solvent for coal direct liquefaction; and hydrogenated anthracene oil obtained by subjecting a solvent for coal to hydrogenation.

Among them, tetralin, THQ and hydrogenated anthracene oil are useful because they have a large hydrogen donating capability and are easily available in industrial scale and also the regeneration of the used solvent is simple.

Now, the inventors have made examinations with respect to properties of mesophase pitches obtained by hydrogenating the tar pitch with the above useful hydrogenation solvents and subsequently performing a heat treatment as a precursor pitch for carbon fiber, and found that the mesophase pitch obtained by treating with tetralin is the most excellent pitch.

Since tetralin, THQ and hydrogenated anthracene oil, particularly tetralin employed for the invention are large in the hydrogen donating capability as compared with creosote and anthracene oils conventionally used as a hydrogenation solvent for heavy bituminous substance such as tar pitch or the like, the hydrogenation can be carried out even under such a low pressure as an extent of naturally generated pressure (10–30 kg/cm$^2$) of the respective solvent (tetralin) without requiring the conventional treatment at a high temperature under a high pressure (150–250 kg/cm$^2$) using hydrogen gas, which has a great merit on the equipment. Furthermore, since the hydrogen in the hydrogenation solvent has a far higher activity than the hydrogen gas, the hydrogenation solvent is very excellent in the hydrogen donating capability.

In addition to the excellent hydrogen donating property, the tetralin has such a property that it acts as a poor solvent for the heavy bituminous substance rich in aromaticity such as tar pitch and has a low solubility. Such two properties of the tetralin are used in the present invention to produce a precursor pitch for carbon fibers.

The method of the invention will be described in detail below. At first, a soft pitch among the tar pitches is subjected to a hydrogenation in the presence of the tetralin at a heating temperature of 400°–450° C. In this case, the mixing ratio of pitch to tetralin is 1:1 ~ 1:5 (preferably 1:2 ~ 1:3).

When the mixing ratio of pitch to tetralin exceeds 1, the hydrogenation of the pitch is not sufficiently effected, so that even if the heat treatment is subsequently conducted, the low viscosity precursor pitch cannot be obtained. On the contrary, when the mixing ratio is less than 1/5, the hydrogenation of the pitch too progresses to cause the formation of the low molecular weight pitch, so that the yield of the precursor pitch in the subsequent heat treatment is extremely decreased. From the above, it would appear that the desirable mixing ratio of pitch to tetralin is 1:1 ~ 1:5.

An ambient pressure is 10–30 kg/cm$^2$ corresponding to the pressure naturally generated from the pitch and tetralin.

When the hydrogenated pitch is made from the tar pitch (raw material pitch), it is necessary to remove free carbon of fine particle having a particle size of not more than 1 μm which naturally exists in the raw material pitch. Since the tetralin is a poor solvent for the tar pitch and has a low dissolving power, the solvent insoluble high molecular weight components in the pitch are separated only by decreasing the temperature of the solution after the hydrogenation, whereby sludges of about 0.1–1 mm including the free carbon therein are formed. The separation removal of this sludge is carried out by a centrifugal separation, a filtration or a static separation, which is very simple as compared with the separation removal of only the free carbon.

Additionally, when the sludge solution is heated at 400°–450° C., the high molecular weight components in the tar pitch are hydrogenated and depolymerized into low molecular weight components, but polymer components three-dimensionally highly polymerized through heteroatoms such as oxygen, nitrogen and sulfur are separated and removed as the solvent insoluble components without being depolymerized under this hydrogenation conditions.

By such a treatment, the free carbon and solvent insoluble components including the high molecular weight components are separated and removed, and further the solvent is removed to obtain a hydrogenated pitch. The resulting hydrogenated pitch is a clean and homogeneous pitch having a small amount of heteroatoms and a very uniform molecular weight distribution based on the removal of the high molecular weight components.

Then, a precursor pitch of an advanced mesophase formation can be produced by heat-treating the above hydrogenated pitch in an inert gas atmosphere at a temperature of 400°–500° C. under a reduced pressure of 0.1–10 Torr for relatively short time. The reason why the mesophase formation from the hydrogenated pitch is conducted under the reduced pressure of 0.1–10 Torr is based on the purpose for sufficiently removing low molecular weight components and sublimation components in the pitch which deteriorate the spinnability, infusibility and further carbonization-graphitization properties as a precursor pitch.

In short, the hydrogenated pitch obtained by treating with tetralin is a clean and homogenous pitch having a small amount of heteroatoms and a uniform molecular weight based on the removal of high molecular weight components and is excellent in the heat stability. Therefore, the mesophase formation (formation and coalescence) from the hydrogenated pitch proceeds slowly, which is easy to form a considerably large anisotropic texture domain. This means to form a bulk mesophase having a low Q1 value (value of quinoline insoluble matter) and a low viscosity. Additionally, the composition of quinoline insoluble matter becomes similar to that of quinoline soluble matter in the mesophase pitch, which results in the homogeneous pitch.

For example, the extremely homogeneous precursor pitch containing 10 ~ 30% by weight of quinoline insoluble matter and having 100% optically anisotropic texture under an observation with a polarizing microscope and an excellent spinnability can be obtained.

The following examples are given for the purpose of illustration of the invention and are not intended as limitations thereof.

EXAMPLE 1

1 part by weight of coal tar pitch (29.7% by weight of benzene insoluble matter, 10.0% by weight of quinoline insoluble matter) was mixed with 2 parts by weight of tetralin as a hydrogenation solvent, and then hydrogenated at a temperature of 430° C. for 30 minutes. The pressure after the completion of hydrogenation was 30 kg/cm$^2$.

After the quinoline insoluble matter in the raw material pitch and the solvent insoluble high molecular weight components after the hydrogenation were separated and removed through filtration, the solvent was recovered to obtain a hydrogenated pitch. This hydrogenated pitch had the following analytical values:

benzene insoluble matter: 11.5% by weight
quinoline insoluble matter: trace

Then, the hydrogenated pitch was maintained in $N_2$ gas atmosphere at 480° C. under a reduced pressure of 8 Torr for 15 minutes to form a mesophase pitch. This mesophase pitch contained 89.7% by weight of benzene insoluble matter and 21.6% by weight of quinoline insoluble matter, and had a wholly anisotropic texture under the observation with a polarizing microscope and had viscosities of 1,000 poises at 310° C. and 100 poises at 335° C., respectively.

This mesophase pitch was melt-spun at a temperature of 340° C. in $N_2$ gas under pressure, and as a result the spinning could be carried out over 1 hour or more without cutting off the fiber. Furthermore, the fineness was very uniform as 10–11 μm. This fiber was subjected to infusing treatment in air at 310° C. for 1 hour and further to carbonization in Ar gas at 1,000° C. The resulting carbon fiber had a fineness of 9–10 μm, a tensile strength of 196 kg/mm² and a Young's modulus of 14.5 t/mm². Moreover, when the carbon fiber was subjected to graphitization at 2,600° C., a high-performance carbon fiber having a fineness of 8–9 μm, a tensile strength of 320 kg/mm² and a Young's modulus of 45 t/mm² was obtained. EXAMPLE 2

1 part by weight of coal tar pitch (15.0% by weight of benzene insoluble matter, 0.2% by weight of quinoline insoluble matter) was mixed with 3 parts by weight of tetralin as a hydrogenation solvent, and then hydrogenated at 430° C. for 30 minutes. The pressure after the completion of hydrogenation was 40 kg/cm². After the trace of quinoline insoluble matter in the raw material pitch and the solvent insoluble high molecular weight components after the hydrogenation were separated and removed through filtration, the solvent was recovered to obtain a hydrogenated pitch. This hydrogenated pitch had the following analytical values:

benzene insoluble matter: 11.5% by weight quinoline insoluble matter: trace The analytical values of the raw material pitch and the hydrogenated pitch are shown in the following Table 1. From Table 1, it is understood that the amounts of heteroatoms such as nitrogen, sulfur and oxygen were decreased by changing the raw material pitch to the hydrogenated pitch.

Then, the hydrogenated pitch was maintained in an $N_2$ gas atmosphere at 485° C. under a reduced pressure of 5 Torr for 10 minutes to form a mesophase pitch. This mesophase pitch contained 92.3% by weight of benzene insoluble matter and 24.3% by weight of quinoline insoluble matter and had a wholly anisotropic texture under an observation with a polarizing microscope and had a viscosity of 100 poises at 340° C.

The mesophase pitch was melt-spun at a temperature of 340° C. in $N_2$ gas under pressure, and as a result the spinning could be carried out over 1 hour or more without cutting off the fiber. Furthermore, the fineness was very uniform as 10–11 μm. This fiber was subjected to infusing treatment in air at 310° C. for one hour and further to carbonization in Ar gas at 1,000° C. The resulting carbon fiber had a fineness of 9–10 μm, a tensile strength of 205 kg/mm² and a Young's modulus of 15.2 t/mm². Moreover, when the carbon fiber was subjected to graphitization at 2,600° C., a high-performance carbon fiber having a fineness of 8–9 μm, a tensile strength of 310 kg/mm² and a Young's modulus of 40 t/mm² was obtained.

TABLE 1

| | Analysis of pitch | |
|---|---|---|
| | Raw material pitch | Hydrogenated pitch |
| Softening temperature (°C.) | 90.0 | 90.4 |
| Benzene insoluble matter (% by weight) | 15.0 | 10.5 |
| Quinoline insoluble matter (% by weight) | 0.2 | trace |
| Carbon (% by weight) | 92.15 | 93.10 |
| Hydrogen (% by weight) | 4.28 | 4.89 |
| Nitrogen (% by weight) | 1.60 | 1.00 |
| Sulfur (% by weight) | 0.48 | 0.21 |
| Oxygen (% by weight) | 1.49 | 0.80 |

COMPARATIVE EXAMPLE 1 part by weight of the same coal tar pitch as used in Example 1 was mixed with 2 parts by weight of a hydrogenated anthracene oil and then hydrogenated at 430° C. for 30 minutes. The pressure after the completion of hydrogenation was 25 kg/cm². After the quinoline insoluble matter in the raw material pitch was separated and removed through filtration, the solvent was recovered to obtain a hydrogenated pitch. This hydrogenated pitch had the following analytical values:

benzene insoluble matter: 15.3% by weight quinoline insoluble matter: trace

The hydrogenated pitch was maintained in an $N_2$ gas atmosphere at 470° C. under a reduced pressure of 9 Torr for 15 minutes to form a mesophase pitch. This mesophase pitch contained 85.6% by weight of benzene insoluble matter and 35.6% by weight of quinoline insoluble matter, but when observing it with a polarizing microscope, optically isotropic texture was dispersed in the anisotropic texture, the percentage of the anisotropic texture being 90%. Further, the mesophase pitch had viscosities of 1,000 poises at 340° C. and 100 poises at 365° C., which viscosities were high as compared with that of the pitch treated with tetralin.

The mesophase pitch was melt-spun at a temperature of 370° C. in $N_2$ gas under pressure, and as a result the resulting fiber was cut off one time per 10–15 minutes and further the fineness varied within a range of 12–16 μm. This fiber was subjected to infusing treatment and carbonization in the same manner as described in Examples 1 and 2 to obtain a carbon fiber having a fineness of 11–15 μm, a tensile strength of 160 kg/mm² and a Young's modulus of 13.3 t/mm². Even when the carbon fiber was subjected to graphitization at 2,600° C., the fibrous properties were reached only to a fineness of 10–14 μm, a tensile strength of 240 kg/mm² and a Young's modulus of 32 t/mm², the scatterings of which became large.

According to the invention, as mentioned above, the precursor pitch suitable for the production of high-performance carbon fibers having excellent fibrous properties can be produced efficiently and simply.

What is claimed is:

1. In a method of producing a precursor pitch for carbon fiber by hydrogenating a tar pitch to obtain a hydrogenated pitch containing no free carbon and high molecular weight components, and then subjecting it to a heat treatment, the improvement which comprises carrying out said hydrogenation for a soft or middle pitch as the coal tar pitch, in the presence of tetralin as a solvent at a temperature of 400°–450° C., removing the tetralin and its insoluble components from the hydrogenated pitch, and after said removing step carrying out said heat treatment in an inert gas atmosphere at a temperature of 450°–500° C. and under a reduced pressure of 0.1–10 Torr, so as to obtain a low viscosity mesophase pitch containing 10–30% by weight of quinoline insoluble matter, and having 100% optically anisotropic texture as the precursor pitch.

2. The method as claimed in claim 1, wherein said soft or middle pitch and tetralin are hydrogenated in a mixing ratio of 1:1 ~ 1:5.

3. The method as claimed in claim 2, wherein said mixing ration is 1:2 ~ 1:3.

* * * * *

UNITED STATES PATENT OFFICE

CERTIFICATE OF CORRECTION

PATENT NO. : 4,589,975

DATED : May 20, 1986

INVENTOR(S) : Kozo Yudate, Yukihiro Ohsugi, Mamoru Kamishita and Ken Nagasawa

It is certified that error appears in the above-identified patent and that said Letters Patent are hereby corrected as shown below:

Insert --Assignees: KAWASAKI STEEL CORPORATION and NITTO BOSEKI CO., LTD., Kobe City and Fukushima City, Japan --.

Signed and Sealed this

Twenty-eighth Day of October, 1986

[SEAL]

*Attest:*

DONALD J. QUIGG

*Attesting Officer* *Commissioner of Patents and Trademarks*